US007757443B2

(12) United States Patent
Ringness

(10) Patent No.: US 7,757,443 B2
(45) Date of Patent: Jul. 20, 2010

(54) SUPPORT SYSTEM FOR STAIR TREADS

(75) Inventor: Jeffrey A. Ringness, Irving, TX (US)

(73) Assignee: Acme Services Company, LLP, Fort Worth, TX (US)

( * ) Notice: Subject to any disclaimer, the term of this patent is extended or adjusted under 35 U.S.C. 154(b) by 638 days.

(21) Appl. No.: 11/399,253

(22) Filed: Apr. 6, 2006

(65) Prior Publication Data

US 2007/0234653 A1 Oct. 11, 2007

(51) Int. Cl.
*E04F 11/00* (2006.01)
*A47G 29/02* (2006.01)

(52) U.S. Cl. ..... 52/182; 52/191; 52/188; 248/250

(58) Field of Classification Search ..... 52/182, 52/191, 188, 716.8, 800.12, 18; 182/228.1, 182/228.3; 248/250, 231.71, 316.1, 235
See application file for complete search history.

(56) References Cited

U.S. PATENT DOCUMENTS

| | | | | | |
|---|---|---|---|---|---|
| 1,234,615 | A * | 7/1917 | Bourdeau | 182/228.3 |
| 1,616,899 | A * | 2/1927 | Ingersoll | 182/228.3 |
| 1,676,915 | A * | 7/1928 | Schulzke | 182/220 |
| 1,775,285 | A * | 9/1930 | Little | 182/228.3 |
| 1,878,850 | A * | 9/1932 | Hilgers | 108/28 |
| 2,867,855 | A * | 1/1959 | Xanten | 182/97 |
| 3,416,282 | A * | 12/1968 | Daugherty | 52/716.8 |
| 3,471,111 | A * | 10/1969 | MacDonald | 248/235 |
| 3,713,511 | A * | 1/1973 | Hinkle | 182/95 |
| 4,406,347 | A * | 9/1983 | Stathopoulos | 182/1 |
| 4,508,301 | A * | 4/1985 | Nicholson et al. | 248/250 |
| 4,736,918 | A * | 4/1988 | Bessinger | 248/250 |
| 4,738,426 | A * | 4/1988 | Bessinger | 248/250 |
| 4,765,575 | A * | 8/1988 | Bergl et al. | 248/250 |
| 4,821,892 | A * | 4/1989 | Randall | 211/90.01 |
| 4,871,136 | A * | 10/1989 | Bessinger et al. | 248/250 |
| 4,934,642 | A * | 6/1990 | Baron et al. | 248/250 |
| 5,020,758 | A * | 6/1991 | Rawlyk | 248/250 |
| D318,414 | S * | 7/1991 | Righini | D8/381 |
| 5,064,158 | A * | 11/1991 | Brazier et al. | 248/250 |
| 5,357,724 | A * | 10/1994 | Sonoda | 52/182 |
| 5,509,634 | A * | 4/1996 | Gebka et al. | 248/316.7 |
| 5,636,483 | A | 6/1997 | Wille | |
| 6,047,506 | A * | 4/2000 | Kemper | 52/179 |
| 6,554,236 | B2 * | 4/2003 | Marsh | 248/235 |
| D478,999 | S | 8/2003 | Jobs et al. | |
| 2004/0006939 | A1 * | 1/2004 | Jobs et al. | 52/235 |
| 2006/0049323 | A1 * | 3/2006 | Anzai | 248/250 |

FOREIGN PATENT DOCUMENTS

| | | | |
|---|---|---|---|
| DE | 102005035560 | B3 * | 11/2006 |
| GB | 2053666 | A * | 2/1981 |
| JP | 10299209 | A * | 11/1998 |

* cited by examiner

*Primary Examiner*—Robert J Canfield
*Assistant Examiner*—Babajide Demuren
(74) *Attorney, Agent, or Firm*—Gardere Wynne Sewell LLP

(57) ABSTRACT

A stair tread support member for releasably supporting generally planar stair tread members including stair tread members made of glass or other transparent material includes a general planar base part adapted to be supported on a stairway stinger. The tread support member includes spaced apart flanges forming a channel shaped slot for receiving and supporting a stair tread member. A cushioning member may be interposed the support flanges and the stair tread member. Removable threaded fasteners are engageable with the second flange for retaining the stair treads secured to the tread support member. An elongated cap fits in a slot in the second flange and covers the fasteners.

11 Claims, 4 Drawing Sheets

SUPPORT SYSTEM FOR STAIR TREADS

BACKGROUND OF THE INVENTION

In many stairway structures it is desirable to provide for replaceable stair treads and for supporting the stair treads securely. Proper support of glass stair treads, for example, has been a somewhat vexatious problem in the art of stair tread support systems. The support system should, of course, avoid concentration of support forces on the stair tread, securely retain the stair tread in its working position, preferably offer some cushioning for reacting forces exerted on the stair tread when being traversed by pedestrians, and minimize noise transmission or amplification from the stair tread to the stairway structure. It is to meet the desiderata and needs of stair tread support systems that the present invention has been developed.

SUMMARY OF THE INVENTION

The present invention provides an improved stair tread support system and stair tread support member.

In accordance with one aspect of the present invention, opposed stair tread support members are provided which are particularly adapted to releasably support generally planar stair treads in a manner which suitably secures the stair tread in a fixed working position while also providing for easy removal and replacement or repair of the stair treads, if and when needed. In particular, the stair tread support members are adapted for supporting glass stair treads, for example.

In accordance with yet a further aspect of the present invention, a stair tread support member is provided which includes a generally planar plate-like base part, a first integral transverse support flange and a second support flange disposed spaced from the first flange, and also integrally formed with or detachably connected to the base part. A stair tread cushioning member is adapted for placement on the first flange and engageable with the base part and the second flange. The second flange may also be formed as a separate part releasably securable to the base part by mechanical fasteners.

Still further, in accordance with the invention, a stair tread support member is provided including one or more threaded fasteners threadedly engaged with a second flange and with a tread member or a cushioning member interposed the tread member and the fastener for securing the tread member to the tread support member. The tread support member may further include an elongated removable trim cap for covering the heads and/or threaded openings for receiving the tread or flange retaining fasteners. Opposed removable retainers may be releasably secured to the tread support member at opposite ends thereof.

Those skilled in the art will further appreciate the abovementioned advantages and superior features of the invention together with other important aspects thereof upon reading the detailed description which follows in conjunction with the drawings.

DETAILED DESCRIPTION OF THE PREFERRED EMBODIMENTS

Figure 1:
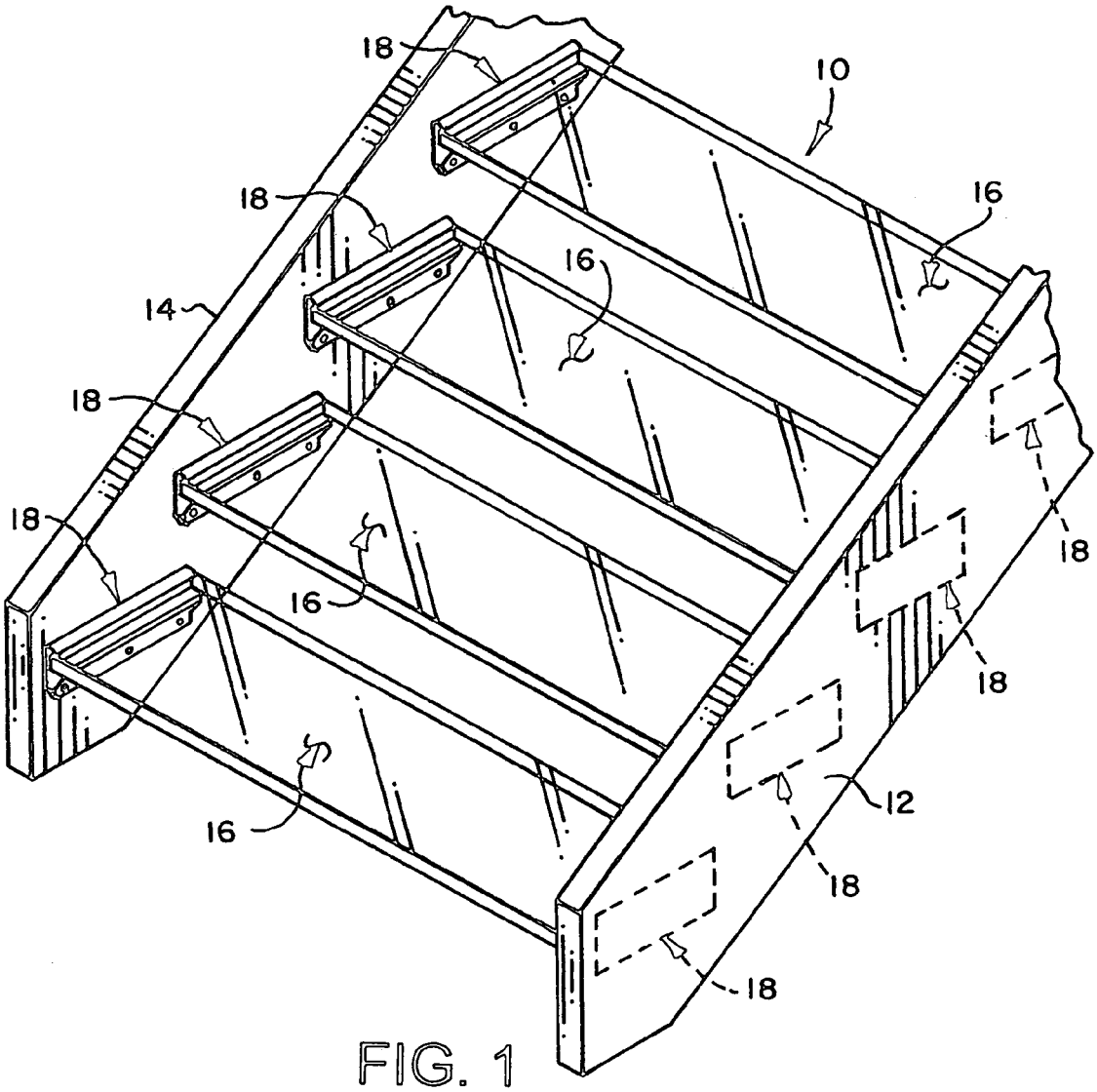
FIG. 1 is a perspective view of a portion of a stairway which includes a stair tread support system and support members thereof in accordance with the invention.

In the description which follows like parts are marked throughout the specification and drawing with the same reference numerals, respectively. The drawing figures may not be to scale and certain elements may be shown in generalized or somewhat schematic form in the interest of clarity and conciseness.

Referring to FIG. 1, there is illustrated a portion of a stairway, generally designated by the numeral 10, including a stair tread support system in accordance with the invention. Stairway 10 includes opposed parallel extending stringer members 12 and 14 which are characterized as generally planar members in the embodiment illustrated. Stairway 10 also includes spaced apart tread members 16 which are also characterized as generally planar, rectangular members and, in the embodiment shown, are preferably formed of glass or a similar transparent or translucent material of aesthetically pleasing quality. The tread members may each be a unitary member or "built-up" of plural laminated plate-like members. The tread members 16 are supported between and on the stringers 12 and 14 by an improved support system including opposed tread support members 18, respectively. The tread support members 18 are of identical and symmetrical configuration and may be used on either of stringers 12 or 14.

Figure 2:
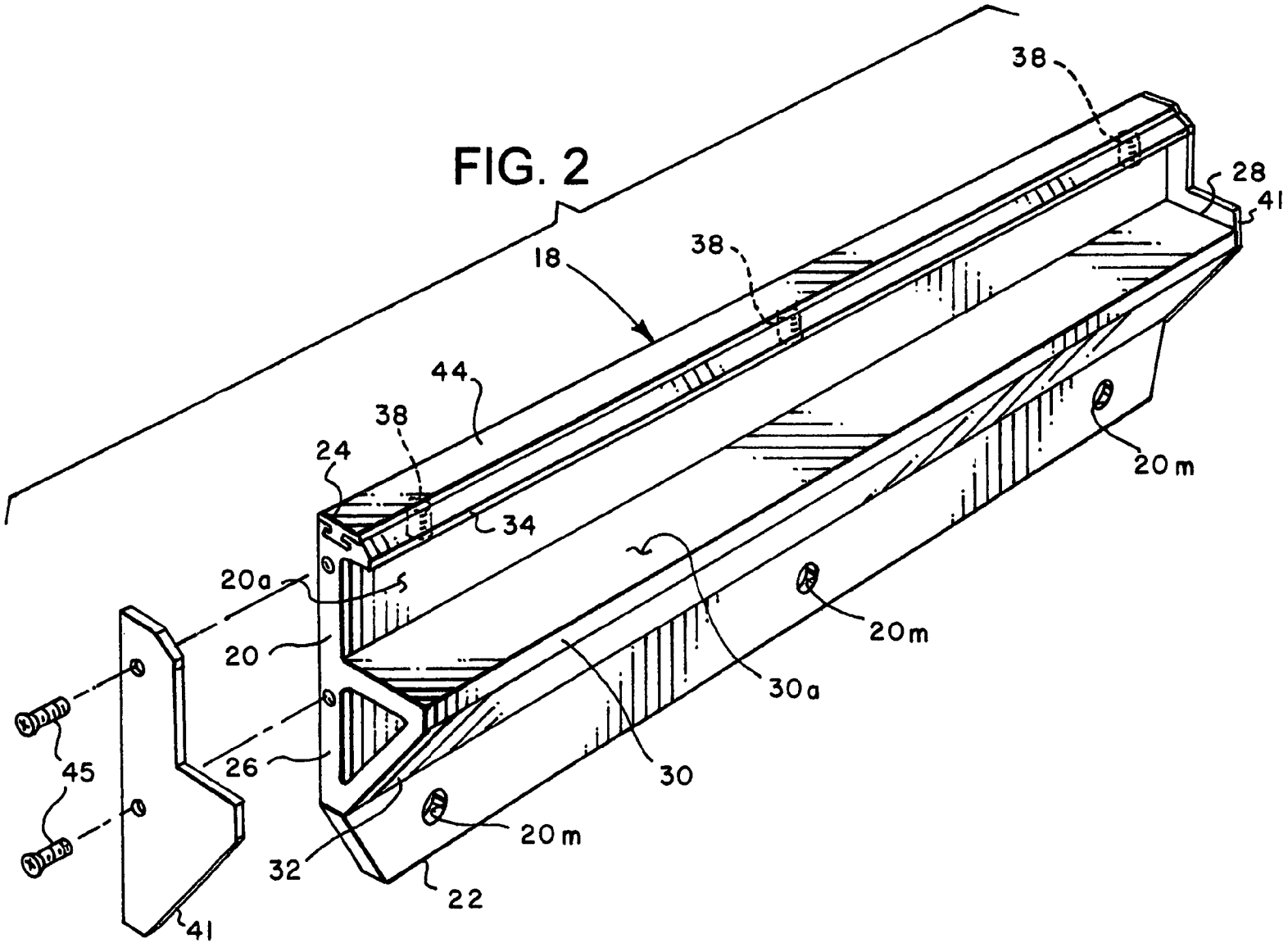
FIG. 2 is a perspective view of one preferred embodiment of a stair tread support member in accordance with the invention.
Figure 3:
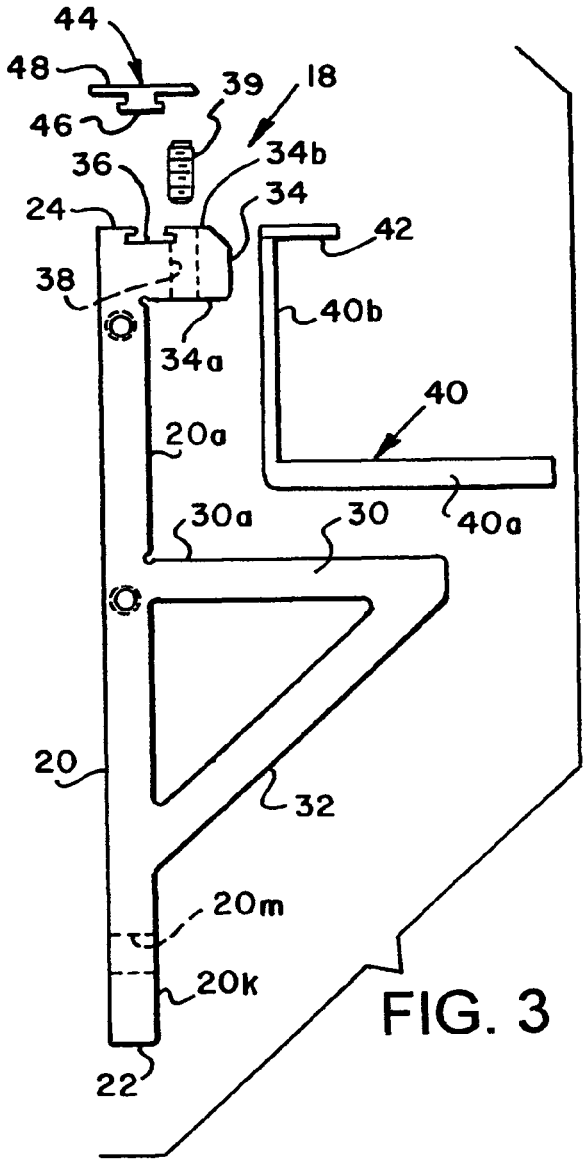
FIG. 3 is an exploded transverse view of the stair tread support member shown in FIG. 2, and including a tread cushioning member.

Referring now to FIGS. 2 and 3, there is illustrated in further detail one of the tread support members 18 of the present invention. Tread support member 18 includes a generally planar, elongated base part 20 delimited by a lower transverse end 22, an upper transverse end 24 and opposed longitudinal end walls 26 and 28. An integral transverse support flange 30 projects normal to the inwardly facing planar surface 20*a* of base part 20 and is reinforced by a longitudinally extending strut part 32 which is also, preferably, formed integral with the flange 30 and the base part 20. Flange 30 is of a greater width than a second flange also integrally formed with the base part 20 and generally designated by the numeral 34. Flange 34 is spaced from flange 30 and both flange 34 and flange 30 are provided with opposed facing planar parallel surfaces 34*a* and 30*a*, respectively. Flange 34 is provided with a longitudinally extending upward facing so-called T-shaped or dovetail-shaped slot 36 which opens to the end walls 26 and 28 of the tread support member. Flange 34 is also provided with spaced apart tread fastener receiving holes or openings 38, one shown in FIG. 3, each for receiving a sockethead type thread fastener 39 also as shown in FIG. 3. Threaded opening 38 extends between surface 34*a* and a surface 34*b* delimiting the upper surface of flange 34.

Referring further to FIGS. 2 and 3, a lower portion 20*k* of base part 20 is provided with spaced apart fastener receiving openings 20*m* for securing the tread support member 18 to one of the stringers 12 and 14 using conventional mechanical fasteners, not shown. Still further, as shown in FIG. 3, the tread support system of the invention includes a somewhat "L" shaped tread cushioning member 40 including a base part 40*a* and an upstanding leg part 40*b* integrally formed with the base part 40*a* and extending at a right angle thereto. A separate cushioning member cap part 42 may form part of the cushioning member 40 but is preferably formed as a separate member. Stair tread cushioning members 40 and 42 are preferably formed of a clear silicone composition.

Referring still further to FIGS. 2 and 3, an elongated trim cap 44 is provided for the flange 34 and includes a T-shaped or dovetail base 46 and a generally planar head portion 48. Cap 44 may be inserted in the slot 36 from one end wall 26 or the other end wall 28 of the tread support member 18 once the fasteners 39 have been inserted in their working positions, see FIG. 4. As shown in FIG. 2, opposed, removable tread retainer plates 41 may be releasably connected to tread support member 18 by suitable fasteners 45, two shown, for securing the plates to end walls 26 and 28, respectively.

Figure 4:
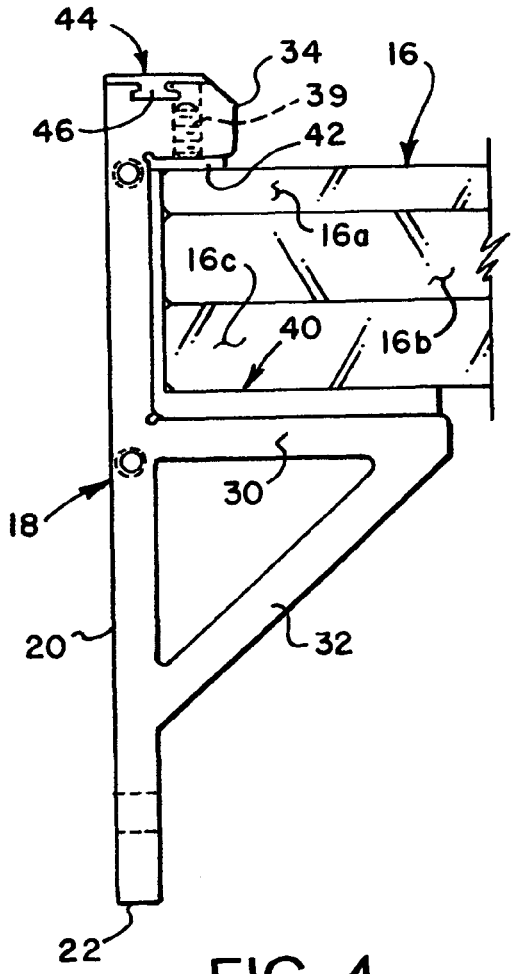
FIG. 4 is a detail view showing the tread support member illustrated in FIG. 3 in assembly with and securing a stair tread.

Referring further to FIG. 4, there is illustrated the tread support member 18 completely assembled and also supporting one end of a tread member, such as the tread member 16. Tread member 16 may be a single thickness plate-like member or a laminated member made up of plural plate-like members 16*a*, 16*b* and 16*c*, as illustrated. Thanks to the cushioning member 40, 42, the fasteners 39 and the configuration of the flanges 30 and 34, the tread member 16 may be securely fastened to the tread support members 18 at opposite ends, FIG. 1, while at the same time each cushioning member 40, 42 minimizes shock loading of its associated tread support member and minimizes the transmission of vibrations from the tread member to the remainder of the stairway system. It will be appreciated by those skilled in the art that the tread members 16 may be easily replaced when needed by removal of the cap 44 for each tread support member 18, loosening or removal of the fasteners 39 and then sliding the ends of the tread members out of the slots formed between the flanges 30 and 34. Tread support members 18 may be formed of extruded metal or plastic, for example, and provided in aesthetically pleasing colors or surface finish and the tread support members 18 may also be easily replaced on the stringers 12 and 14, if desired.

Figure 5:
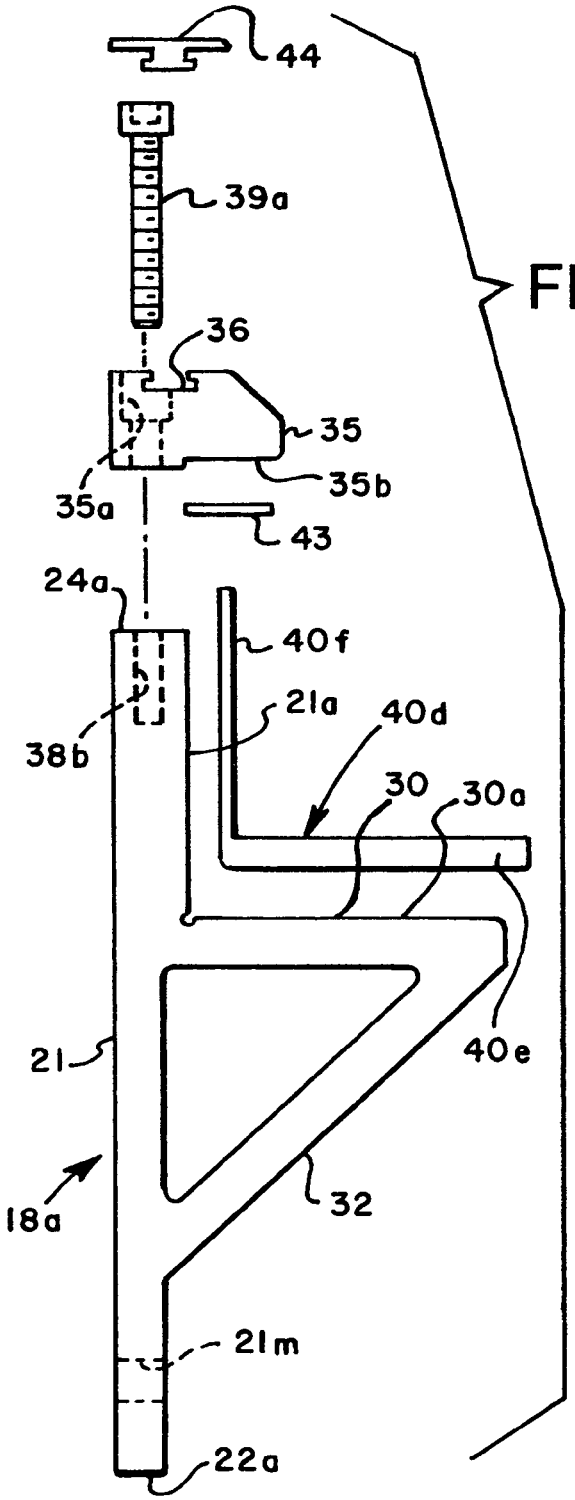
FIG. 5 is an exploded transverse view of an alternate embodiment of a stair tread support member in accordance with the invention.
Figure 6:
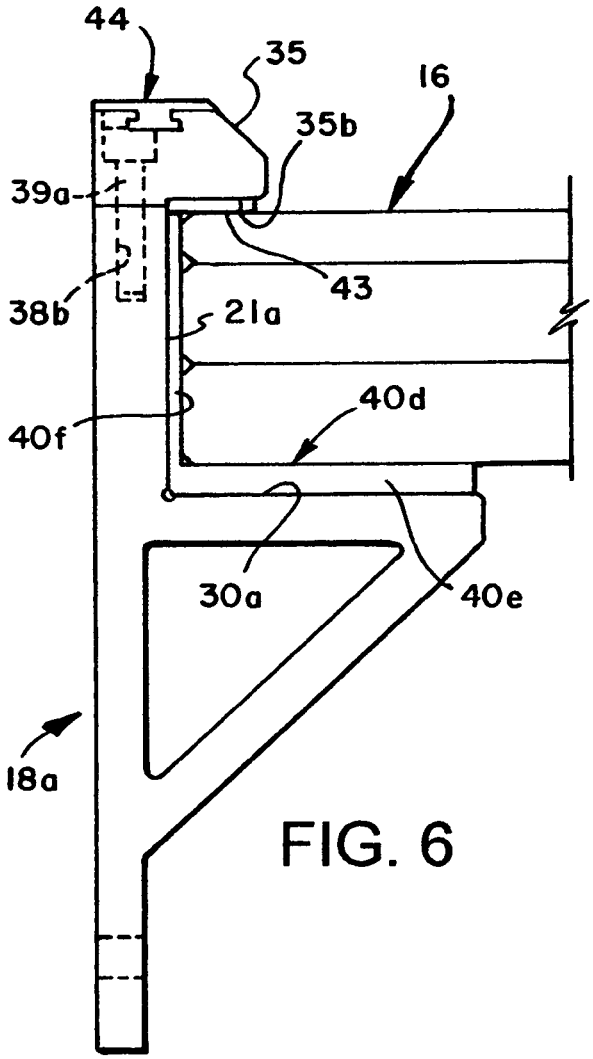
FIG. 6 is a detail view showing the stair tread support member lustrated in FIG. 5 in assembly with and securing a stair tread.

Referring now to FIGS. 5 and 6, there is illustrated another preferred embodiment of a stair tread support member in accordance with the invention. A stair tread support member 18*a* is shown in FIG. 5 in an exploded transverse or end view corresponding to FIG. 3 in some respects. The tread support member 18*a* includes a generally planar base part 21 delimited by an upper edge 24*a* and a lower edge 22*a*. An integral flange 30 extends transversely to the base part 21 and defines surface 30*a* normal to a surface 21*a* delimiting an upper portion of the base part of the tread support member 18A. A difference in the configuration of the tread support member 18*a*, as compared to the tread support member 18, is that an upper portion of the base part 21 is of a greater width than that of the member 18 in order to accommodate one or more fastener receiving openings 38*b*, and a separable upper flange 35 which is provided with an elongated T-shaped or dovetail slot 36 but is also provided with one or more fastener receiving openings 35*a* to receive a threaded fastener 39*a*, preferably a sockethead machine screw, operable to secure the upper flange 35 to the base part 21 and to also operate to secure a tread between a lower surface 35*b* of separable upper flange 35 and the surface 30*a* of integral flange 30. A slightly modified cushioning member 40*d* is provided with opposed integrally joined right angle oriented parts 40*e* and 40*f*. A separate cushioning strip 43 is provided corresponding to the strip 42.

As shown in FIG. 6, the tread support member 18*a* is operable to secure a single or laminated tread, such as the tread 16, by placing the cushioning member 40*d* on surface 30*a* and bearing against surface 21*a* whereby the tread 16 may be securely clamped to the member 18*a* by the separable flange 35 using the recessed or sockethead screws 39*a*, one shown in FIG. 6. The cap 44 is disposed in slot 36 of separable flange 35 once the recessed sockethead screws 39*a* are disposed in their counterbored receiving openings 35*a*, as illustrated. Of course, the length of the tread 16 may require to be shortened slightly or the span between the stringers 12 and 14 may require adjustment for use of the tread support members 18*a* taking into consideration the thickness of the upper part of the base member 21 which defines the surface 21*a*.

The construction and operation of the tread support system and the tread support members 18 and 18*a* of the present invention are believed to be readily understandable to those skilled in the art based on the foregoing description. Conventional engineering materials may be used to provide the support members 18 and 18*a*, as well as the cushioning members 40, 40*d*, 42 and 43, as previously mentioned. Although preferred embodiments of the invention have been described in detail, those skilled in the art will recognize that various substitutions and modifications may be made without departing from the scope and spirit of the appended claims.

What is claimed is:

1. A stairway comprising:

opposed parallel stringer members;

a stair tread member extending between said opposed stringer members;

stair tread support members for supporting respective ends of said stair tread, said stair tread support members being adapted for connection to said stringers, said tread support members comprising:

a generally planar base part fastened to a support surface, including said stringer;

a laterally projecting first flange connected to said base part and including a first support surface for supporting said tread;

a first tread cushioning member comprising an angle shaped member providing respective parts thereof interposed a lateral edge of said tread and said base part and interposed said tread and said first flange, wherein said first tread cushioning member cushions the support of said tread on said support member; and a second flange spaced from and above said first flange a sufficient distance in which said stair tread, said first cushioning member, and a second tread cushioning member are inserted between said flanges, said second cushioning member interposed said tread, said second flange, and a fastener means;

wherein said fastener means is operably connected to said second flange to provide a retaining force exerted on said second cushioning member for retaining said tread connected to said support member.

2. The stairway set forth in claim 1 including:

a removable cap disposed on said second flange and including a part covering said fastener means when said fastener means are forcibly retaining said tread connected to said support member.

3. The stairway set forth in claim 1 including:

a strut connected to said base part and said first flange for reinforcing said first flange against a load imposed on said tread and said first flange.

4. The stairway set forth in claim 1 including:

at least one tread retainer releasably connected to an end wall of said support member.

5. A stairway comprising:

opposed parallel stringer members;

a stair tread member extending between said opposed stringer members;

a stair tread support member for supporting a respective end of said stair tread, said stair tread support member being adapted for connection to a stairway stringer and further comprising:

a generally planar base part having an upper portion and a lower portion, said base part fastened to a support surface, including said stringer;

a laterally projecting first flange connected to said base part and including a first support surface for supporting said tread;

a tread cushioning member comprising an angle shaped member providing respective parts thereof interposed a lateral edge of said tread and said base part and interposed said tread and said first flange;

a second flange removably connected to the top surface of said base part and spaced from and above said first flange a sufficient distance in which said stair tread and said cushioning member are inserted between said flanges; and at least one threaded fastener operably connected to said second flange to secure said second flange to the top surface of said base part and retain said tread connected to said support member;

wherein said upper portion of the base part has a width greater than that of said lower portion of the base part.

6. The stairway set forth in claim 5 including:

a cap member removably connected to said second flange and disposed over said at least one threaded fastener.

7. The stairway set forth in claim 5 including:

a strut connected to said base part and said first flange for reinforcing said first flange against a load imposed on said tread and said first flange.

8. The stairway set forth in claim 5 including:

a further cushioning member interposed said tread and said second flange.

9. The stairway set forth in claim 5 wherein:

said at least one threaded fastener is operable to secure said second flange to said upper portion of said base member.

10. A stairway comprising:

opposed stairway stringers;

at least one stair tread member extending between said opposed stringer members; and a stair tread support system including:

opposed stair tread support members for supporting a stair tread, said stair tread support members being adapted, respectively, for connection to one of said stringers and each further comprising:

a generally planar base part fastened to said stringer;

a laterally projecting first flange connected to said base part and including a first support surface for supporting said tread;

a first tread cushioning member comprising an angle shaped member providing respective parts thereof interposed a lateral edge of said tread and said base part and interposed said tread and said first flange, for cushioning the support of said tread on said support member; and a second flange spaced from and above said first flange a sufficient distance in which said stair tread, said first cushioning member, and a second tread cushioning member are inserted between said flanges, said second cushioning member interposed said tread, said second flange, and a fastener means;

wherein said fastener means is operably connected to said second flange to provide a retaining force exerted on said second cushioning member for retaining said tread connected to said support member.

11. The stairway set forth in claim 10 including:

a removable cap disposed on said second flange and including a part covering said fastener means when said fastener means are forcibly retaining said tread connected to said support member.

* * * * *